US008127727B2

(12) United States Patent
Methley et al.

(10) Patent No.: US 8,127,727 B2
(45) Date of Patent: Mar. 6, 2012

(54) VARIABLE VALVE ACTUATING MECHANISM WITH SUMMATION CAM

(75) Inventors: Ian Methley, Witney (GB); Nicholas Lawrence, Buckingham (GB)

(73) Assignee: Mechadyne, PLC, Kirtlington (GB)

( * ) Notice: Subject to any disclaimer, the term of this patent is extended or adjusted under 35 U.S.C. 154(b) by 311 days.

(21) Appl. No.: 12/598,475

(22) PCT Filed: May 8, 2008

(86) PCT No.: PCT/GB2008/050337

§ 371 (c)(1),
(2), (4) Date: Nov. 2, 2009

(87) PCT Pub. No.: WO2008/139221

PCT Pub. Date: Nov. 20, 2008

(65) Prior Publication Data

US 2010/0132644 A1 Jun. 3, 2010

(30) Foreign Application Priority Data

May 10, 2007 (GB) ..... 0708967.5

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 6,854,434 B2 * 2/2005 Methley ..... 123/90.16
6,941,910 B2 9/2005 Methley

FOREIGN PATENT DOCUMENTS

| | | | |
|---|---|---|---|
| DE | 197 01 201 | A1 | 7/1998 |
| DE | 198 02 738 | A1 | 7/1999 |
| EP | 1 426 569 | A | 6/2004 |
| GB | 2 378 729 | A | 2/2003 |
| WO | 2004/067922 | A | 8/2004 |
| WO | 2006/007817 | A | 1/2006 |

* cited by examiner

*Primary Examiner* — Ching Chang
(74) *Attorney, Agent, or Firm* — Shalom Wertsberger; Saltamar Innovations

(57) ABSTRACT

A mechanism for actuating a poppet valve (28) of an internal combustion engine, comprises two coaxially mounted cams (12,14), cam followers (18,20) in contact with the respective cams (12,14) mounted on a common summation lever (16) which is movable in proportion to the instantaneous sum of the lifts of the two cams (12,14), and a rocker (24) pivotably connected to the summation lever (16) and serving to open the engine valve (28). The rocker is pivotable about a pivot (126) having a fixed preset position and a control spring (134) is provided between the summation lever (16) and a fixed point on the engine to urge the rocker (24) into contact with the tip of the valve (28) and the pivot (126) while the valve is closed.

17 Claims, 5 Drawing Sheets

VARIABLE VALVE ACTUATING MECHANISM WITH SUMMATION CAM

FIELD OF THE INVENTION

The invention relates to an internal combustion engine having an actuating mechanism for a poppet valve that comprises two coaxially mounted cams, cam followers in contact with the respective cams mounted on a common summation lever which is moveable in proportion to the instantaneous sum of the lifts of the two cams, and a rocker pivotably connected to the summation lever and serving to open the engine valve. Such a valve actuating system allows the valve timing, valve lift and valve event duration to be varied by appropriate phasing of the two cams.

BACKGROUND OF THE INVENTION

The accompanying FIGS. 1 and 2 show examples of known valve actuating systems of the type described above. FIG. 1 corresponds to FIG. 3 of U.S. Pat. No. 6,941,910 which is incorporated herein by reference.

In FIG. 1, a single cam phaser (SCP) assembled camshaft 10 has two cams 12 and 14 that can be rotated relative to one another, the cam 12 being formed of two identical parts straddling the cam 14. Cam followers 18 and 20 in contact with the respective cams 12 and 14 are mounted on a common summation lever 16 which is pivotably supported by a pivot pin 22 on a lower rocker 24. At one end, the lower rocker 24 rests on a hydraulic lash adjuster 26 and at the other end it is in contact with the tip of the stem 28 of a valve 30. Up and down movement of the summation lever 16 causes the lower rocker 24 to pivot about the lash adjuster 26 in order to press down on the stem 28 of the valve 30, causing the valve to open by an amount proportional to the sum of the instantaneous lifts of the two cams 12 and 14.

FIGS. 2A, 2B and 2C are side, end and exploded perspective views, respectively, of a second known, and generally similar, valve actuating mechanism. To avoid repetition, like components have been allocated like reference numerals. The mechanism of FIG. 2 acts on the stems 28*a* and 28*b* of two valves 30*a* and 30*b* in unison and the summation lever 16 acts on two lower rockers 24*a* and 24*b*, resting as previously on lash adjusters 26*a* and 26*b*. A spring 34 acts upwards on the end of the summation lever 16 carrying the two cam followers 18.

It is inherent in such a valve actuating mechanism that there is a large clearance between the components when the cam followers 18 and 20 are on the base circles of both cams 12 and 14. Cam summation mechanisms using hydraulic lash adjusting elements consequently require some means for adjustment of the clearance to achieve two aims, namely:

- to limit the expansion of the hydraulic lash adjusters, such that the correct amount of clearance is maintained in the system whilst the valves are closed, and
- to hold the lower rockers in contact with the tips of the valves and with the clearance adjustment system by the expansion of the hydraulic lash adjusters, so as to force the clearance to occur between one of the cam profiles and its respective follower.

To achieve these two aims, the actuating mechanism of FIG. 1 includes an adjustable stop plate 40 which acts to limit the movement of the pivot pin 22 connecting the summation lever 16 to the lower rocker 24. In the mechanism of FIG. 2, an appropriately graded shim 42 surrounding the pin 22 abuts the camshaft 10 to serve the same function.

While it would be possible to achieve the first of the two aims listed above by simply replacing the hydraulic lash adjusting elements with a mechanical clearance adjustment system, such a modification alone would result in the position of the lower rockers becoming indeterminate. This could lead to loss of contact with the valve tip or the rocker pivot, and potentially damaging impact forces between the components of the system.

SUMMARY OF THE INVENTION

According to the present invention, there is provided a mechanism for actuating a poppet valve of an internal combustion engine, comprising two coaxially mounted cams, cam followers in contact with the respective cams mounted on a common summation lever which is movable in proportion to the instantaneous sum of the lifts of the two cams, and a rocker pivotably connected to the summation lever and serving to open the engine valve, characterised in that the rocker is pivotable about a pivot having a fixed preset position and a control spring is provided between the summation lever and a fixed point on the engine to urge the rocker into contact with the tip of the valve and the pivot while the valve is closed.

US2005/0211202 describes by reference to its FIG. 11 a valve mechanism having all the features recited in the preamble of the appended claim 1. This valve mechanism does however use a hydraulic lash adjuster, and the control spring does not act between the summation lever and fixed point on the engine.

By providing a spring to urge the rocker into contact with the valve tip and the pivot while the valve is closed, the invention succeeds in replacing the prior art hydraulic lash adjusters with fixed pivots, while controlling the clearances within the mechanism so that the position of the valve operating rocker(s) is accurately determined in all angular positions of the camshaft.

Preferred embodiments of the invention, as will be described below, are further capable of offering the following advantages, namely:

- Hydraulic elements are not required.
- Graded components are not required as part of the rocker system.
- Simple and repeatable measurement methods may be used to check valve lift.
- The system can be designed such that no significant disassembly is required to adjust the valve lift.
- Adjustments may be made and checked instantly.

BRIEF DESCRIPTION OF THE DRAWINGS

The invention will now be described further, by way of example, with reference to the accompanying drawings, in which:—

DETAILED DESCRIPTION OF THE PREFERRED EMBODIMENT(S)

A primary aim of the present invention is to replace the hydraulic lash adjusters used in the prior art by manually adjustable pivots. This is because many of the advantages that hydraulic lash adjusters provide in a conventional valve train are not relevant to a cam summation system, where the expansion of the lash adjusters needs to be limited. Given that some form of manual adjustment method is required, the invention applies adjustment directly to the valve operating rocker(s) instead of attempting to control the position of the valve train components indirectly by limiting the expansion of a hydraulic lash adjuster.

Figure 1:
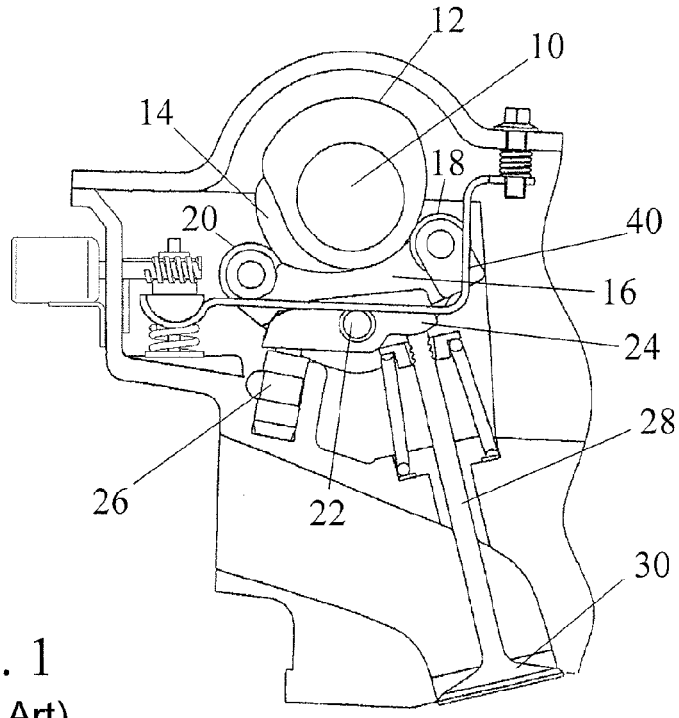
Fig. 1 (Prior Art)
FIGS. 1 and 2, as already described, show known cam summation valve actuating mechanisms using hydraulic lash adjusters.
Figure 2A:
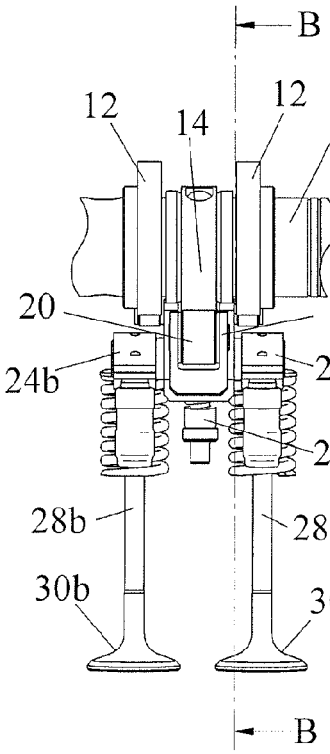
Fig. 2A (Prior Art)
Figure 2B:
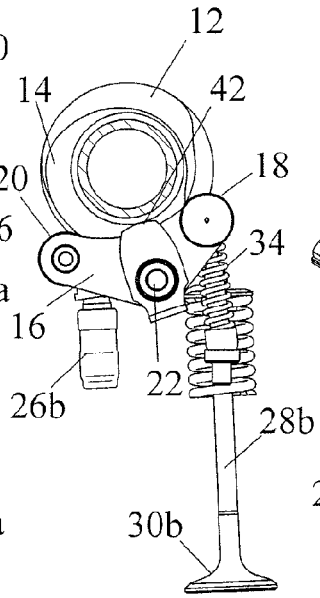
Fig. 2B (Prior Art)
Figure 2C:
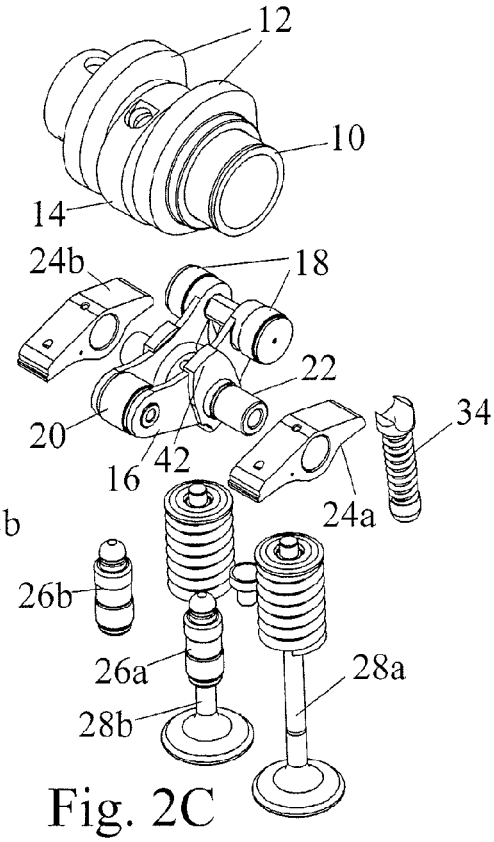
Fig. 2C (Prior Art)

This approach can also result in a more compact system because it is no longer necessary to find space for an adjustment mechanism, such as the stop plate 40 of FIG. 1, or the shim used in FIG. 2. Furthermore, in some of its embodiments, the invention makes it possible to adjust the clearance after the valve actuating mechanism has been fully assembled, or even from the outside of the engine, to improve the ease with which the valve lifts of the different cylinders of an engine may be matched.

The absence of hydraulic lash adjusters in the system means that consistent valve lift measurements can easily be taken without providing a pressurised oil supply to the cylinder head. This offers the possibility for adjusting the valve lifts of each cylinder and re-measuring the valve lift directly.

Figures 3A, 3B, 3C, 3D:
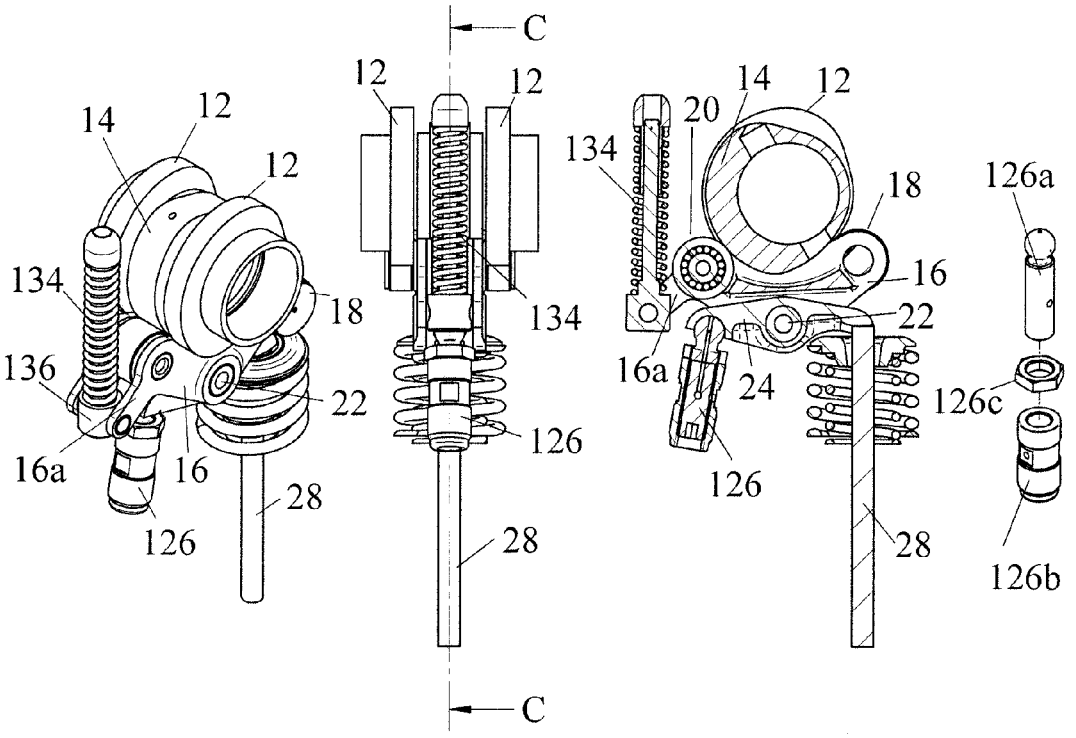
FIG. 3A is a perspective view of a valve train of a first embodiment of the present invention.
FIG. 3B is a side view of the valve train in FIG. 3A.
FIG. 3C is a section on the line C-C in FIG. 3B.
FIG. 3D is an exploded view of the adjustable pivot of the lower rocker.

In the different views of FIG. 3, where once again like components have been allocated the same reference numerals, there is shown an embodiment of the invention generally similar to that of FIG. 1 but in which the hydraulic lash adjusting element 26 has been replaced by a an adjustable rocker support pivot 126. As shown in FIG. 3D the pivot comprises a threaded post 126*a* that may be manually adjusted relative to its socket 126*b* and clamped by means of a locking nut 126*c*. The adjustable pivot 126 may be used to control the level of clearance in the system and hence the valve lift that will be generated.

The other important difference from FIG. 1, which makes it possible to omit the stop plate 40, is the provision of a spring 134 that pushes down on a rearward extension of 16*a* of the summation lever 16. The pivot 22 will therefore always apply a downward force to the lower rocker 24 keeping it in contact with the fixed pivot 126 and the valve stem 28 while allowing a clearance to build up between one of the cam followers 18 and its associated cams 12, whilst the cam follower 20 is held in contact with its associated cam 14 by the action of the spring 134.

The spring 134 in the embodiment of FIGS. 3A to 3D is a compression spring that acts between a fixed point on the cylinder head and a cradle 136 that is pivotably mounted on the extension 16*a* of the summation lever 16.

The remaining embodiments of the invention now to be described all operate on the same principle of providing an adjustable pivot for the lower rocker 24 and a spring for urging the lower rocker into contact with the adjustable pivot at one end, and with the valve stem at the other. The embodiments differ from one another in the design of the adjustable pivot, in the design of spring, and in the number of valves that they actuate.

Figures 4A, 4B:
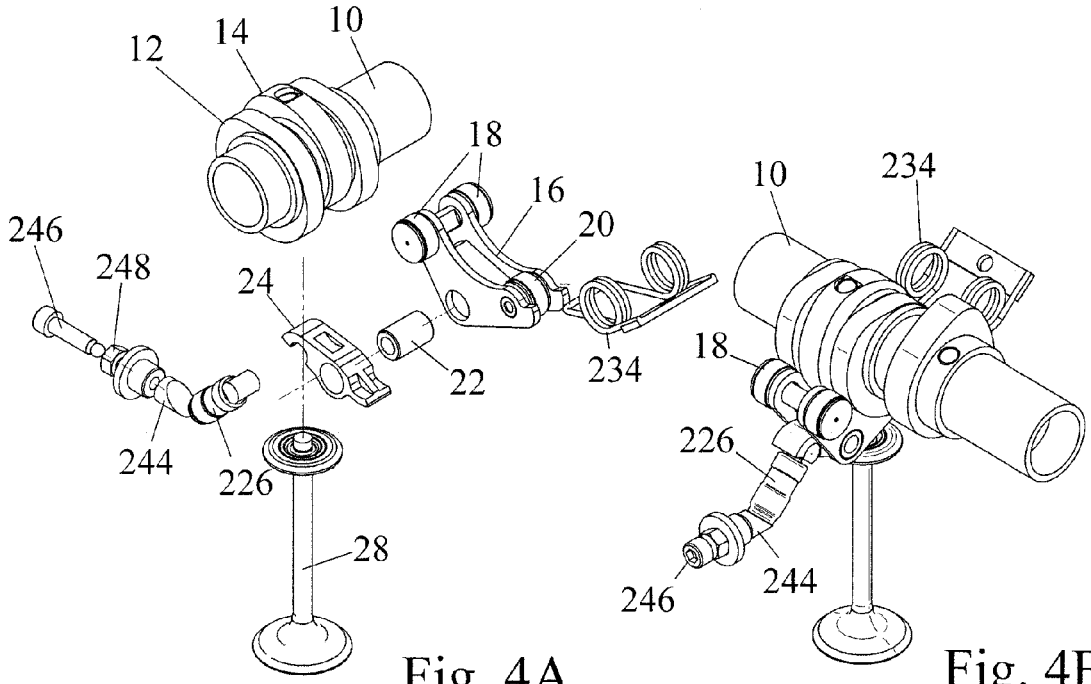
FIG. 4A is a perspective exploded view from one side of a second embodiment of the invention.
FIG. 4B is a perspective view from the other side of the embodiment shown in FIG. 4A in its assembled state.
Figure 4C:
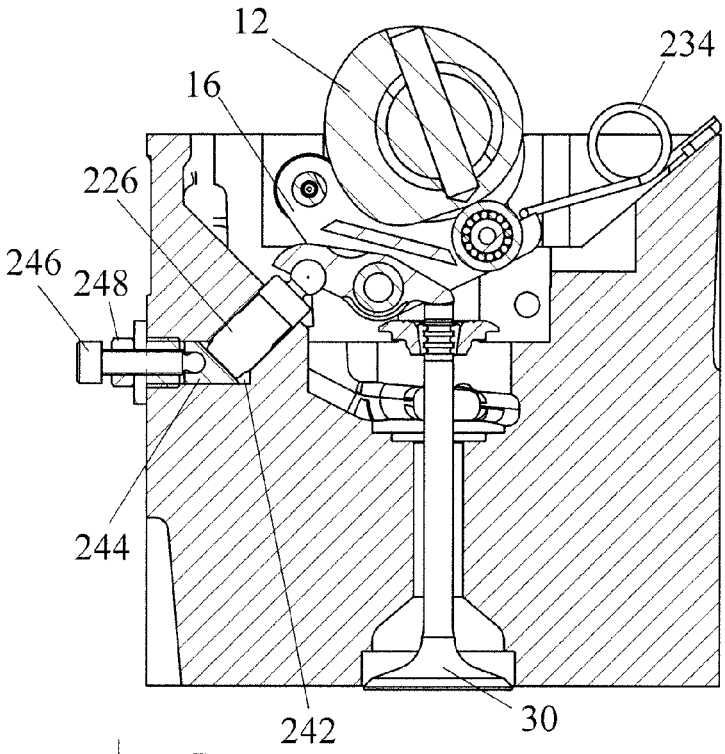
FIG. 4C is a section through the embodiment of FIGS. 4A and 4B when mounted in a cylinder head.

The embodiment of FIGS. 4A to 4C differs from that of FIGS. 3A to 3D in that the compression spring 134 acting on a rearward extension of the summation lever has been replaced by a torsion spring 234 acting on the front end of the summation lever 16, but still in a direction to act downwards on the lower rocker 24. Furthermore, in place of a pivot 126 having a post of adjustable length, a pivot 226 with a post of fixed length is mounted in the cylinder head in such a manner that its position can be adjusted from outside the cylinder head after assembly has been completed and even while the engine is running. The post of the pivot 226 has an inclined lower face and is mounted in a bore in the cylinder head that intersects a second bore at an angle. An adjustment wedge 244 can be moved in the second bore 242 by means of a screw 246 and can be secured in position by means of a lock nut 248. By moving the wedge 244 in its bore, the interaction between the two inclined surfaces will cause the post of the pivot 226 to move in its bore to set the desired clearance within the valve actuating system.

It is also noted from this embodiment of the invention that the head of the pivot 226 need not be part-spherical, as shown in FIG. 3D but may be part-cylindrical.

Figure 5A:
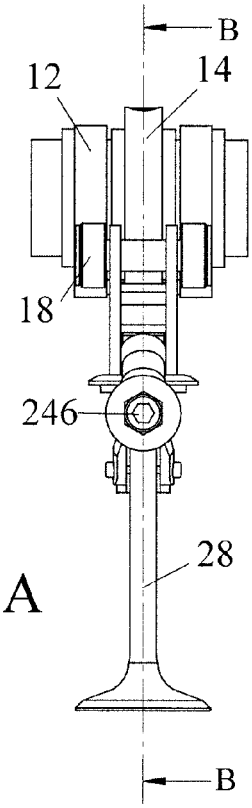
FIG. 5A is a side view of a third embodiment of the invention.
Figure 5B:
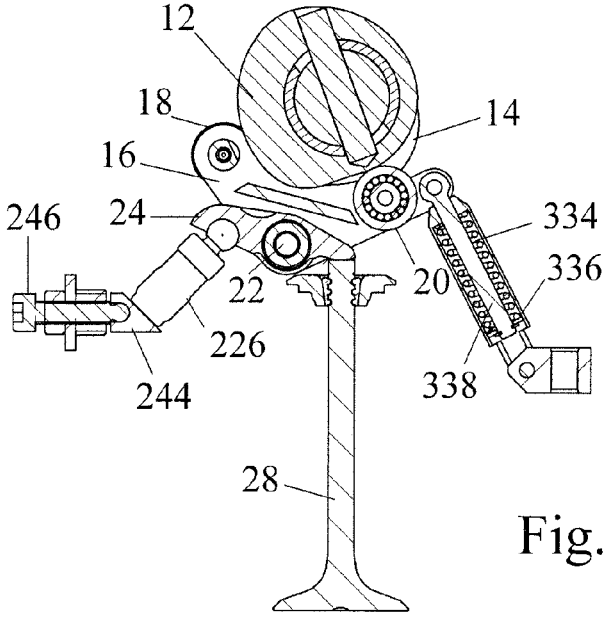
FIG. 5B is a section along the line B-B in FIG. 5A, FIGS. 6A and 6B are perspective assembled and exploded views, respectively, of the fourth embodiment of the invention.

The embodiment of FIGS. 5A and 5B only differs from that of FIGS. 4A and 4B in the design of the spring 334. A coil spring is used on the front end of the summation lever 16 and it is attached to a point lower than the tip of the valve stem 28. Because of this geometry, the spring 334 needs to pull down on the summation lever 16 which would suggest the use of an expansion spring. However, as there are issues with the reliability of expansion springs, a compression spring 334 is used which is encased in a cylinder 336 anchored to the engine cylinder head, the spring acting between the cylinder head and a piston mounted on a rod 338 that is pivotably connected to the summation lever 16.

Figure 6A:
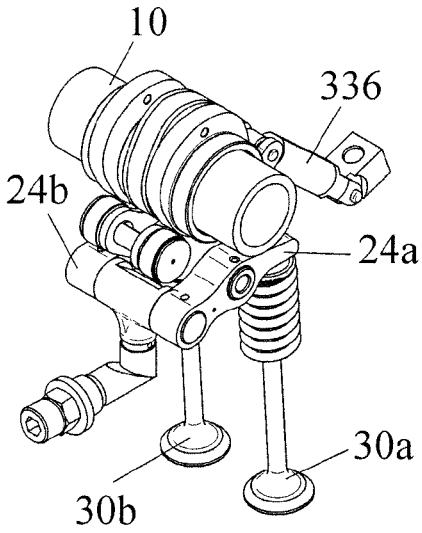
Figure 6B:
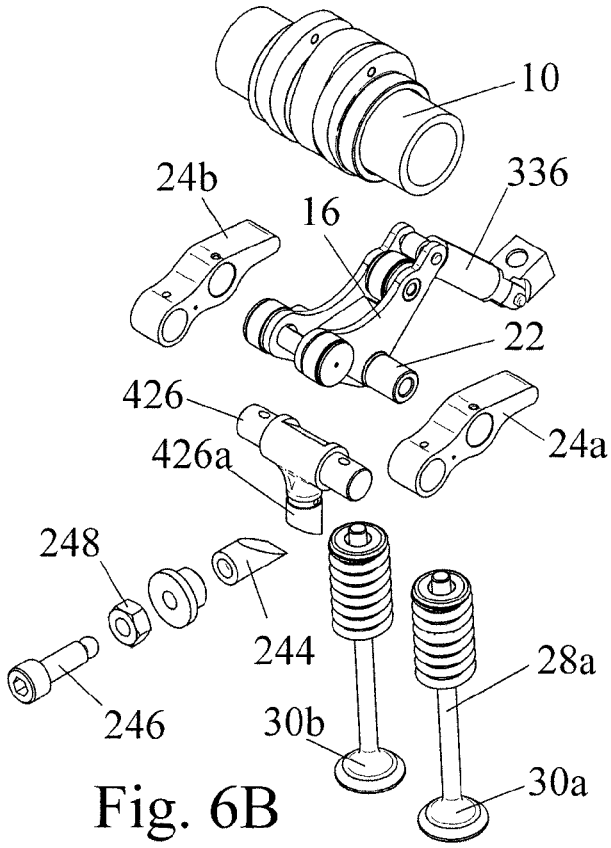

The embodiment of FIGS. 6A and 6B differs from that of FIGS. 5A and 5B in that it acts on two valves 30*a* and 30*b* and like the prior art actuation mechanism of FIG. 2 has two lower rockers 24*a* and 24*b* mounted on a pivot shaft 22 of the summation lever 16. In this embodiment, the ends of lower rockers 24*a* and 24*b* are pivoted on a second pivot shaft 426 that is rigidly mounted on a post 426*a* to form a T-piece that is adjustable in height in the same manner as has been described in connection with FIGS. 4 and 5.

In order to use a single adjustment for a pair of valves, it is important for no significant differences to exist in the valve tip positions of the pair of valves relative to the camshaft axis, as there is no means for compensating for this type of variation and different valve lift characteristics on the two valves would result. If any difference in the fitted valve heights were to exist, it can be detected prior to fitting the valve train and could be corrected either by using a valve of slightly different length, or by using a simple shimming arrangement on the top of each valve to eliminate the error.

Figure 7A:
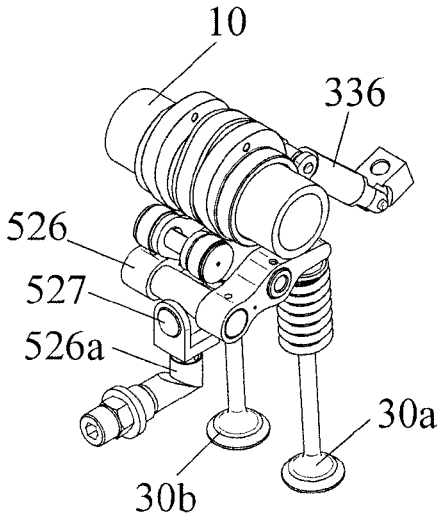
FIGS. 7A and 7B are views similar to those of FIGS. 6A and 6B showing a fifth embodiment of the invention.
Figure 7B:
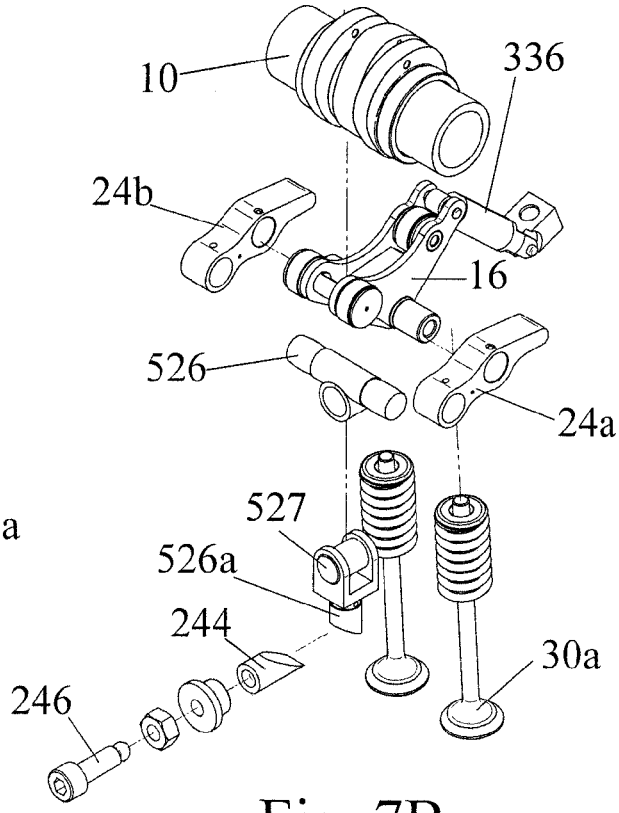

To address this same problem, the embodiment of FIGS. 7A and 7B differs from the previous embodiment in that the second pivot shaft 526 can itself pivot relative its post 526*a* about an axis of a pin 527 perpendicular to that of the second pivot shaft 526. In this case, the pivot pins at the ends of the pivot shaft 526 may be barrelled to make line contact rather than surface contact with the bores in the lower rockers 24*a* and 24*b*.

The embodiment of FIGS. 8A to 8D uses a cantilever mechanism to adjust the clearance in the system. In particular, the end of the lower rocker 624 is pivoted to an articulated link 650 that itself rocks about a ball 652 acting as a fixed fulcrum. The opposite end of the link 650 is pivotably connected to the end of an adjustment bolt 654. The adjustment bolt is fitted with adjusting mechanism that has discrete settings, rather than utilising a lock-nut to clamp the adjusting screw.

The adjusting bolt 654 has a fine pitch thread that engages in an upper pivot 660 which is itself rotatably located in the cylinder head. The upper pivot 660 has a ball bearing 662 or similar feature that engages with castellations 664 in the skirt of a collar 666 that is constrained to rotate with the adjusting bolt 654. The collar castellations 664 are held in contact with the ball by the action of a spring that causes the system to have a series of discrete adjustment positions.

The lower end of the adjusting bolt 654 is engaged rotatably with a second pivot 668 that is rotatably received in aligned bores in the arms of a fork that forms part of the articulated link 650.

Figure 8A:
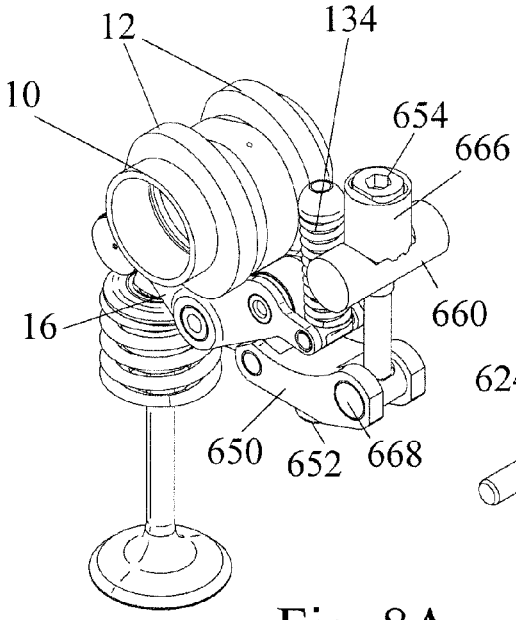
FIGS. 8A and 8B are views similar to those of FIGS. 7A and 7B shown a sixth embodiment of the invention.
Figure 8B:
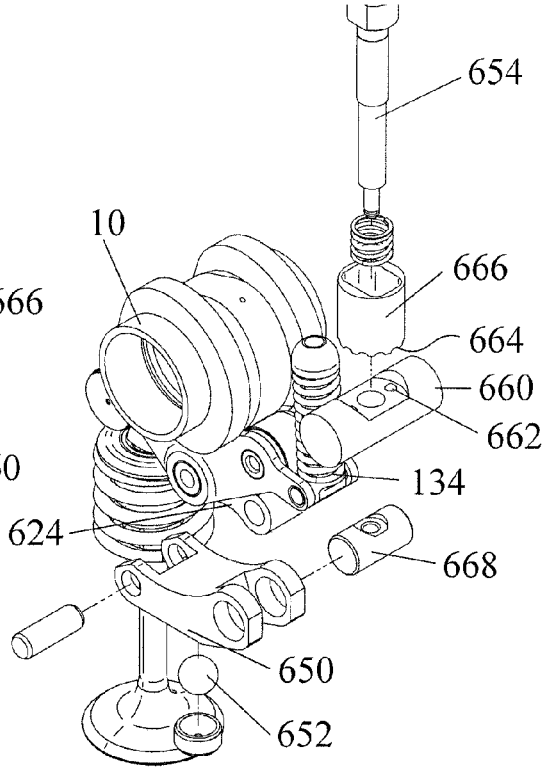
Figure 8C:
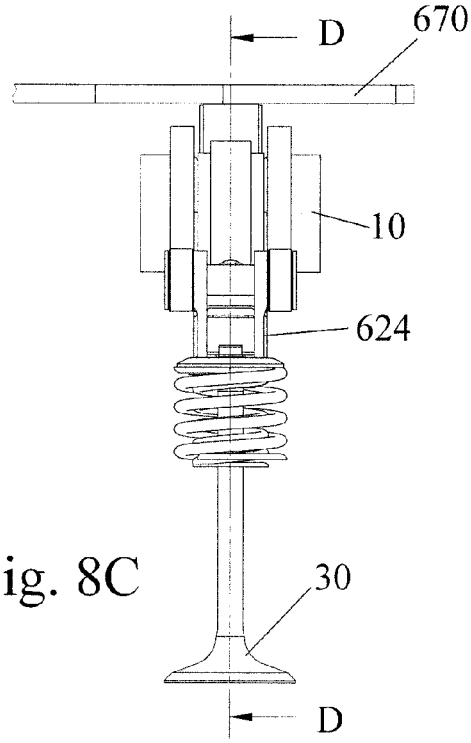
FIG. 8C shows a side view of the valve actuating mechanism of FIGS. 8A and 8B when fitted in a cylinder head.
Figure 8D:
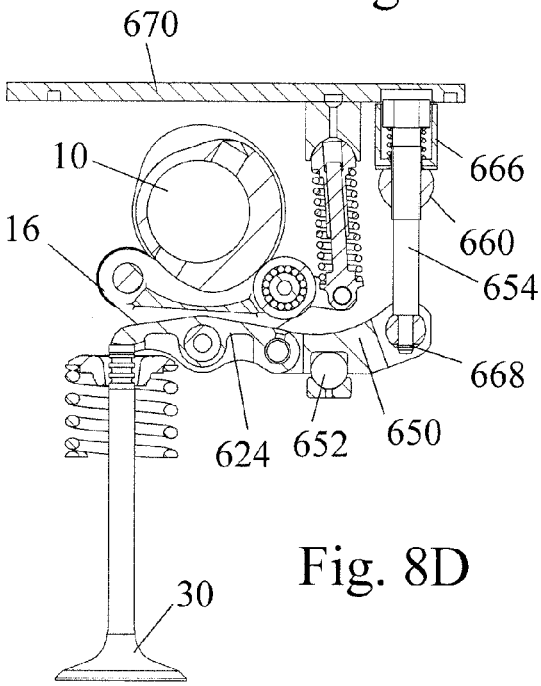
FIG. 8D is a section along the line D-D in FIG. 8C.

It can be seen from FIGS. 8C and 8D that an engine cover 670 needs to be removed in order to adjust the clearance in the system. This is an advantage because it gives access to the valve train for clearance measurement, it prevents any possibility of oil leaking from the adjusting system, and the fitting of the cover acts to lock the adjustment system in position.

Fitting the engine cover prevents any movement of the adjusting system due to vibration because the castellated collar 666 no longer has sufficient clearance to compress its spring and ride over the ball 662 fitted to the upper pivot.

One further feature of this embodiment of the invention is that the control spring 134 only becomes preloaded when the engine cover is fitted, greatly improving the ease of assembly and adjustment.

The invention claimed is:

1. A mechanism for actuating a poppet valve of an internal combustion engine, comprising:

two coaxially mounted cams, each having a cam profile;

cam followers in at least intermittent contact with the respective cams a common summation lever which is movable in proportion to the instantaneous sum of the lifts of the two cams, the cam followers being coupled to the common summation lever;

a rocker pivotably connected to the common summation lever and serving to open the poppet valve;

the rocker being pivotable about a pivot having a preset position; and, a control spring coupled to the summation lever and to a fixed point on the engine, to urge the rocker against a portion of the poppet valve and the pivot while the poppet valve is closed.

2. A mechanism as claimed in claim 1, wherein the control spring also acts to hold at least one of the cam followers in contact with its respective cam profile at all times.

3. A mechanism as claimed in claim 1, wherein the rocker is supported by a solid pivot that engages in the cylinder head, and the position of the pivot in the cylinder head is adjustable by a screw mechanism.

4. A mechanism as claimed in claim 3, wherein the screw mechanism is accessible to enable the clearance to be adjusted when the valve actuating mechanism is fully assembled in the engine.

5. A mechanism as claimed in claim 4, wherein the screw mechanism includes an adjusting screw and a locknut.

6. A mechanism as claimed in claim 1, wherein at least one rocker is pivotably supported by one end of an articulated link which is pivoted about a fixed pivot in the cylinder head and is coupled to a screw mechanism for adjusting the position of the end supporting the rocker.

7. A mechanism as claimed in claim 6, wherein the screw mechanism is accessible to enable the clearance to be adjusted when the valve actuating mechanism is fully assembled in the engine.

8. A mechanism as claimed in claim 7, wherein the screw mechanism includes an adjusting screw and a locknut.

9. A mechanism as claimed in claim 1, further comprising a second rocker for actuating a second poppet valve, wherein the two rockers being connected to the common summation lever for opening the respective valves, and wherein the rockers are supported on a common solid pivot that engages in the cylinder head, and the position of the pivot in the cylinder head is adjustable by a screw mechanism.

10. A mechanism as claimed in claim 9, wherein the screw mechanism is accessible to enable the clearance to be adjusted when the valve actuating mechanism is fully assembled in the engine.

11. A mechanism as claimed in claim 10, wherein the screw mechanism includes an adjusting screw and a locknut.

12. A mechanism as claimed in claim 1, further comprising a second rocker for actuating a second poppet valve, wherein the two rockers being connected to the common summation lever for opening the respective valves, and wherein the two rockers are supported by a pivot shaft that is free to rotate about an axis perpendicular to the axis of the pivot shaft and the position of the axis of the pivot shaft relative to the cylinder head is adjustable by a screw mechanism.

13. A mechanism as claimed in claim 12, wherein the screw mechanism is accessible to enable the clearance to be adjusted when the valve actuating mechanism is fully assembled in the engine.

14. A mechanism as claimed in claim 13, wherein the screw mechanism includes an adjusting screw and a locknut.

15. A mechanism as claimed in claim 1 wherein the pivot is adjustable by an adjuster having discrete settings.

16. A mechanism as claimed in claim 15, wherein movement of a screw mechanism is prevented by an access cover serving to inhibit movement of the adjuster.

17. A mechanism as claimed in claim 1, wherein one end of the control spring abuts a removable access cover, whereby the control spring is only tensioned when the removeable access cover is installed.

* * * * *